US005346146A

United States Patent [19]

Nitta

[11] Patent Number: 5,346,146

[45] Date of Patent: Sep. 13, 1994

[54] VERTICAL PULVERIZER

[75] Inventor: Sachihito Nitta, Yao, Japan

[73] Assignee: Kubota Corporation, Osaka, Japan

[21] Appl. No.: 38,265

[22] Filed: Mar. 29, 1993

[30] Foreign Application Priority Data

Mar. 30, 1992 [JP] Japan ..... 4-074363
Jan. 22, 1993 [JP] Japan ..... 5-009303

[51] Int. Cl.[5] ..... B02C 19/22
[52] U.S. Cl. ..... 241/172; 241/57
[58] Field of Search ..... 241/171, 172, 46.17, 241/57; 366/319, 320, 324, 343

[56] References Cited

U.S. PATENT DOCUMENTS 3,350,280 10/1967 West ..... 241/172 X
4,754,934 7/1988 Ikebuchi et al. ..... 241/172 X
5,178,338 1/1993 Zakheim et al. ..... 241/172

*Primary Examiner*—Douglas D. Watts
*Attorney, Agent, or Firm*—Wenderoth, Lind & Ponack

[57] ABSTRACT

A vertical medium-stirring type pulverizer has a wear-preventive structure for preventing wear of its screw blade. The structure includes a plurality of magnets provided on the top surface of the screw blade. At least one of the pulverizing medium and the material to he pulverized which are contained in the pulverizing shell of the pulverizer is a magnetic material. The magnets serve to attract the magnetic medium or material thereto to form a lining on the top surface of the screw blade. A similar wear-preventive structure may be provided on the inner surface of the shell to prevent wear of the inner surface of the shell.

6 Claims, 6 Drawing Sheets

VERTICAL PULVERIZER

BACKGROUND OF THE INVENTION

This invention relates to a vertical medium-stirring type pulverizer provided with means for preventing wear of the inner surface of the pulverizing shell and the top surface of a screw blade.

FIG. 1 shows a vertical medium stirring type pulverizer which comprises a vertical pulverizing shell 1 filled with pulverizing medium b such as steel balls and a vertical screw shaft 2 mounted in the shell. With the screw shaft 2 in rotation, the material a to be pulverized is introduced into the shell 1 and is stirred up and down together with the pulverizing medium b. The particles of the material a collide with each other and with the pulverizing medium D, so that the material is pulverized into an end product c having a fine particle size. The end product c thus made is carried on the flow of a fluid d such as air or water and taken out of the shell 1.

Since the material a and the pulverizing medium b are stirred in the shell 1, the inner surface of the shell 1 and the surface of screw blade 5 are subjected to a large frictional force. Thus, it is necessary to provide some wear-preventive means on these portions. Typically, such a wear-preventive means was a wear-resistant liner laminated on these portions.

But liners having high wear resistance are usually expensive. On the other hand, cheap liners are less wear-resistant and thus have to be replaced frequently.

In order to prevent these problems, the present applicant has proposed a wear-preventive structure in Japanese Unexamined Utility Model Publication 4-37541. As shown in FIG. 9, this structure comprises ribs 4 provided on the top surface of the screw blade 3 of the screw shaft 2 and extending diametrically so as to be angularly, spaced apart from each other. This arrangement can reduce the wear of the screw blade 3.

While the material a and medium b are moving in the shell 1, the ribs 4 serve to prevent the movement of the medium and material on the blade 3. In this state, although the medium trapped on the blade 3 may be rubbed against the moving medium, no large frictional force will be produced between the trapped medium and the top surface of the blade 3. Namely, the trapped pulverizing medium performs the function of lining the screw blade. Thus, the moving pulverizing medium b never rubs the top surface of the blade 3, so that the blade 3 is protected against wear and the pulverizer can be operated continuously for a longer period of time.

But, as shown in FIG. 9, since the ribs 4 are erected, like walls, on the blade 3 at a right angle with respect to the direction of rotation (shown by arrow) of the screw shaft 2, they will reduce the force tending to raise the pulverizing medium b, produced by the blade 3, thus lowering the flowability. Also, as shown in the same figure, a cavity 5 tends to be formed behind each rib 4. No medium-raising force is produced in these cavities 5. Thus, the flowability will decrease.

Japanese Examined Patent Publication 44-29838 discloses a conventional means for forming a self-lining layer A (FIG. 10), made up of pulverizing medium similar to the self-lining disclosed in the above prior art, on the inner surface of the pulverizing shell. In this prior art, as shown in FIG. 10, vertical ribs (rods 15) and circumferentially extending ribs (ledges 14) are provided on the inner surface of the shell 1. Pulverizing medium b trapped in tile spaces defined by the ribs 14 and 15 performs the self-lining function.

But, in this arrangement, the pulverizing medium b tends to move downwards by gravity. Thus, the self-lining layer A in each space tends to be thinner at the upper portion than at the lower portion as shown in FIG. 1. Also, as shown in FIG. 12, the self-lining layer A tends to be thinner at the front portion with respect to the direction of rotation of the screw shaft 2. Thus, in order to form a self-lining layer A that covers the entire inner surface of the pulverizing shell 1, it would be necessary to reduce the distances between ribs 15 and 14 (rods and ledges). For this purpose, a greater number of ribs 14 and 15 have to be used and thus it is more troublesome to mount them. Moreover, the use of a greater number of ribs leads to an increased number of damaged ribs and thus more frequent replacement work. These factors will all push up the cost.

On the other hand, in horizontal medium stirring type pulverizers, a horizontal pulverizing shell is rotated by its shaft. A wear-preventive means for preventing wear on the inner surface of this type of pulverizing shell is disclosed in Japanese Examined Patent Publication 58-5706, U.S. Pat. No. 3,913,851, and U.S. Pat. No. 4,340,616, etc. This wear-preventive means is magnets stuck on the inner surface of the pulverizing shell. The magnets serve to attract magnetic pulverizing medium and the material to be pulverized, thus forming a self-lining layer A on the inner surface of the pulverizing shell.

But, with a horizontal pulverizing machine, the pulverizing medium tends to be repeatedly attracted to and separated from the magnets while the pulverizing shell is rotating. Thus, the self-lining layer A cannot be formed effectively.

SUMMARY OF THE INVENTION

Under these circumstances, the present inventors noticed the fact that, in the case of a vertical medium-stirring type pulverizer, the self-lining layer A formed by the pulverizing medium trapped on the inner surface of the pulverizing shell or on the top surface of the screw blade is kept stationary even while the other part of the pulverizing medium b is moving in the shell. Based on this finding, they invented means for forming a self-lining layer A reliably and at low cost.

Namely, an object of this invention is to provide means for forming a self-lining layer on necessary portions of a vertical medium-stirring type pulverizer.

In order to achieve this object and solve the above problems in the prior art according to this invention, in a vertical medium-stirring type pulverizer comprising a vertical pulverizing shell and a vertical screw shaft mounted in the shell and provided with a screw blade, the pulverizing shell being filled with a pulverizing medium and a material to be pulverized, at least one of the medium and the material being a magnetic material, a plurality of magnets are provided on at least one of the top (uppermost) surface of the screw blade and the inner surface of the vertical pulverizing shell.

A plurality of diametric ribs are provided on the top surface of the screw blade and arranged at predetermined intervals and the magnets may be arranged between the ribs.

On the inner surface of the pulverizing shell, vertical ledges and horizontal ribs may be provided as spaced apart a predetermined distance from one another and the magnets may be provided between the vertical ribs and between the (circumferential) horizontal ledges.

In this arrangement, the magnets serve to attract part of the magnetic pulverizing medium and material to be pulverized. The medium and material attracted to the magnets are magnetized and attract further medium and material thereto. In this way, a self-lining layer made pulverizing medium is formed around the magnets. By arranging the magnets at predetermined intervals, a lining having a uniform thickness can be formed on the surface provided with the magnets.

When the pulverizer is actuated and the material is pulverized in this state, the pulverizing medium trapped on the inner surface of the shell and/or the top surface of the screw blade is kept immovable because the levels of the inner surface and the top surface never change unlike a horizontal pulverizer in which the pulverizing shell is rotated. Thus, the thickness of the self-lining layer can be kept uniform by the magnets.

In the arrangement further comprising ribs, the ribs serve to check the movement of the lining more reliably and thus to keep its thickness at a sufficient level more reliably. Namely, by the cooperation of the resistance of the ribs and the magnetic force of the magnets, a lining made up of pulverizing medium and having a uniform thickness is formed more reliably on the entire top surface of the screw blade and on the entire inner surface of the pulverizing shell. Since the lining is formed uniformly, cavities similar to the above-mentioned cavities 5 will never form. Since the ribs are completely buried in the lining, they will never hinder the upward flow of the pulverizing medium.

According to this invention, part of the pulverizing medium and the like is attracted to the magnets, thus forming the lining. Thus, compared to conventional wear-preventive means comprising liners or rods and ledges, the wear-preventive means according to the present invention has a simple structure and is, easy to mount and inexpensive. Further, it can increase the durability of the inner surface of the pulverizing shell and the uppermost surfaces of the blades.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
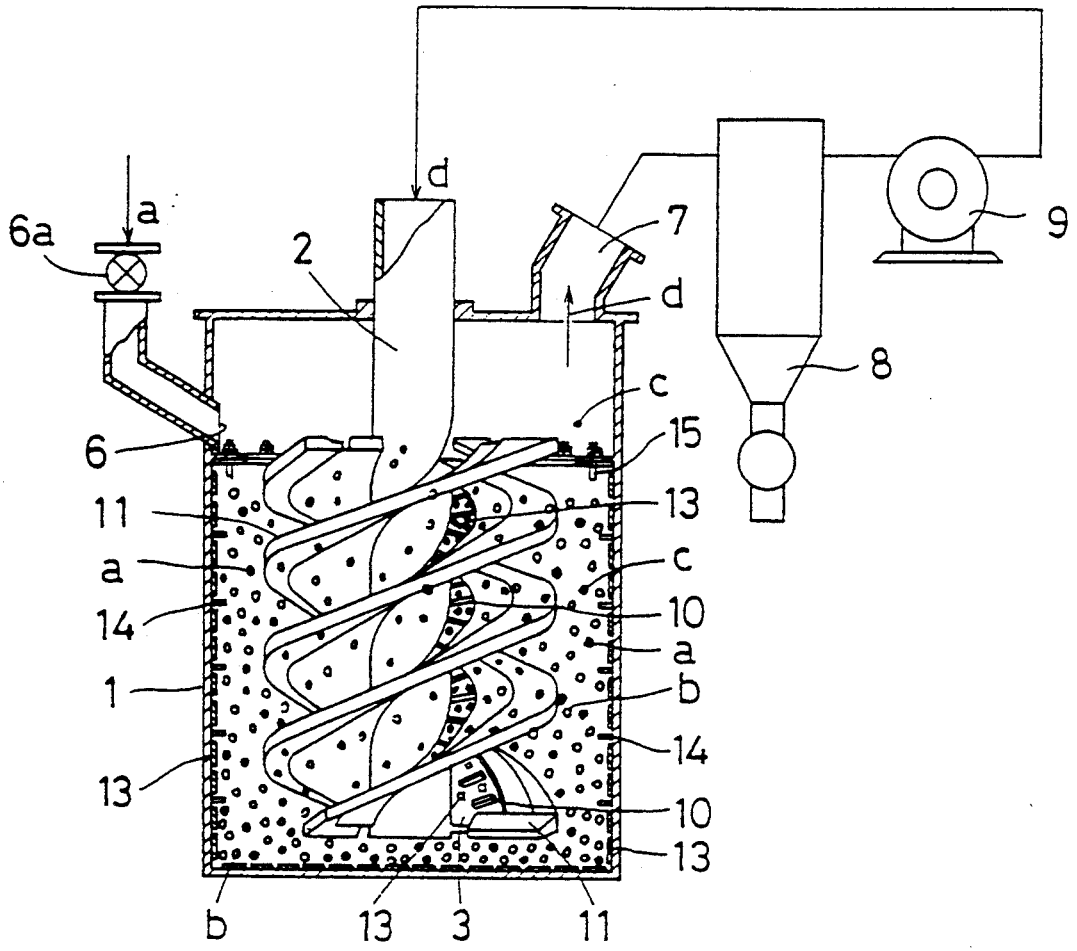
FIG. 1 is a schematic sectional view of one embodiment of a medium-stirring pulverizer according to the present invention.

As shown in FIG. 1, a screw shaft 2 having two rows of spiral blades 3 is mounted in a vertical cylindrical pulverizing shell 1. In the upper part of the shell 1 are provided an inlet port 6 for the material a to be pulverized and an outlet port (suction port) 7 for an end product c. A rotary valve **6*a* is provided in the inlet port 6. The valve 6*a* serves to feed the material a to be pulverized into the shell 1 while keeping airtightness. A suction fan 9 is connected to the outlet port 7 through a product collector 8 such as a bag filter or a cyclone. Air is circulated through the hollow screw. Shaft 2, pulverizing shell 1 nd collector 8 by the fan 9**.

Figure 3:
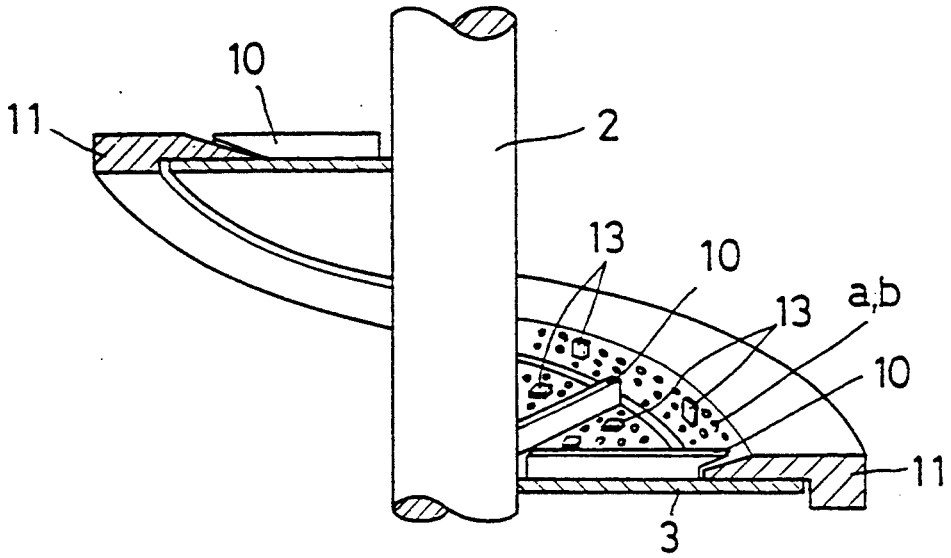
FIG. 3 is a partially cutaway perspective view of a screw blade of the same embodiment.

As shown in FIG. 3, ribs 10 in the form of thin plates are fixed to the top surfaces of the blades 3 by welding. Liners 11 are bolted to the blades 3 around the ribs 10 in the same manner as in conventional arrangements. The height of the ribs and the distance between the adjacent ribs are determined taking into account the particle diameter of the pulverizing medium and the amount of the medium trapped on the blades. The liners 11 may be omitted.

Figure 7:
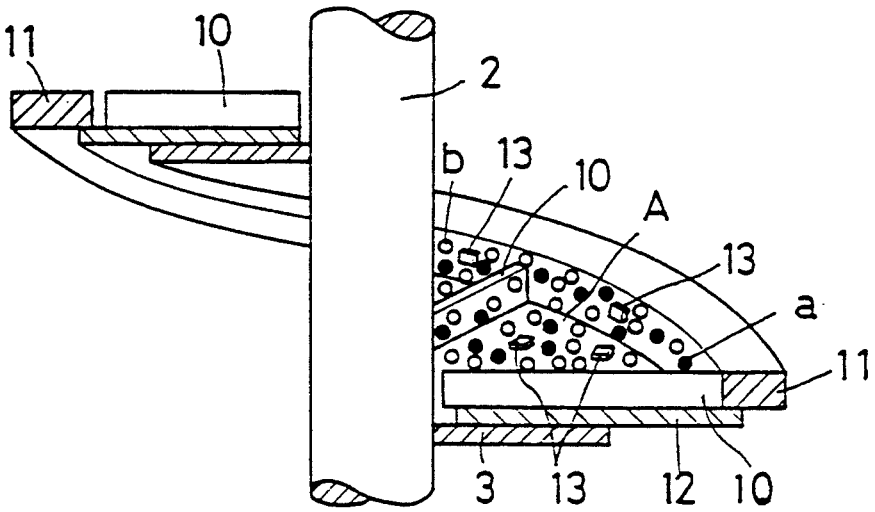
FIG. 7 is a partially cutaway perspective view of a screw blade of another embodiment.

As shown in FIG. 7, after coupling the liner 11 and ribs 10 together through backing plates 12, the plates 12 may be fixed to the blades 3 by welding or by bolts.

Between the ribs 10, permanent magnets 13 are screwed on the blades 3. The magnets 13 serve to attract the pulverizing medium b and the material a to be pulverized that come into the spaces between the ribs 10 so that the thickness of the layer made up of the pulverizing medium and the material will be kept uniform over the entire area thereof. The size, number and position of the magnets should be determined so that the thickness of the layer will be uniform. The magnets 13 may be fixed to the blades 3 not by screws but by welding, bonding or projection-to-recess fitting or by any other known means. When fitting the magnets to the blades, dove-tail groove structures are preferable. The magnets 13 may be made of a synthetic resin such as rubber, metal or any other known material.

Figure 2:
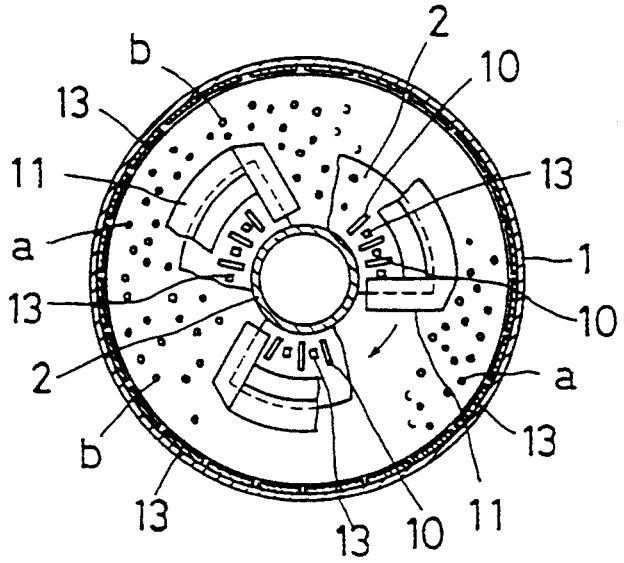
FIG. 2 is a sectional view of the same embodiment.
Figure 4:
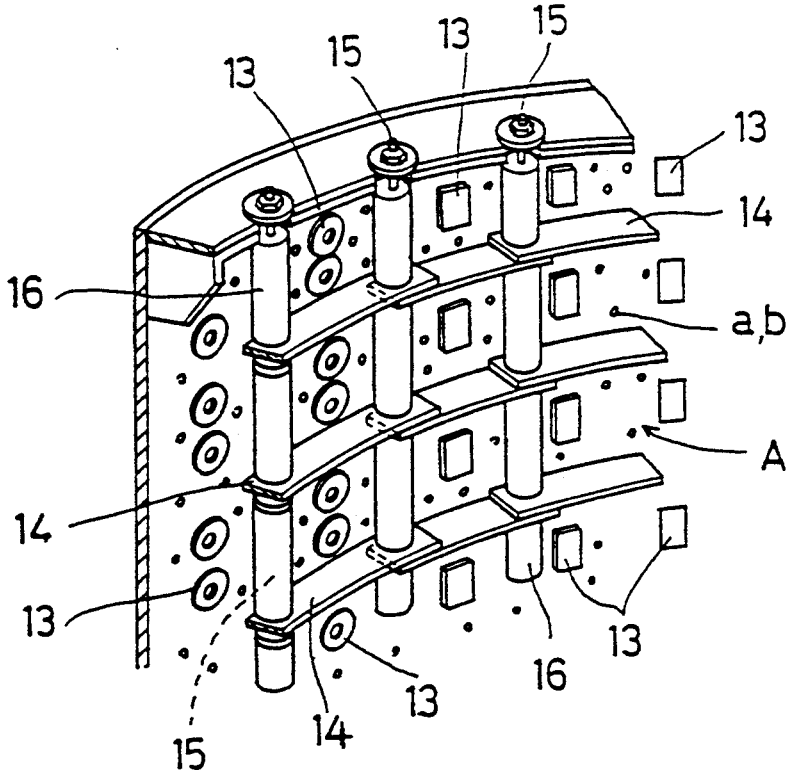
FIG. 4 is a partially cutaway perspective view of a shell of the same embodiment.

As shown in FIGS. 1, 2 and 4, horizontal ribs or edges 14 are provided on the inner surface of the pulverizing shell 1 so as to be vertically spaced apart a predetermined distance from each other. The ledges 14 are fixed in position by means of cylindrical spacers 16 forming vertical ribs and rods 15 in the form of long bolts. The ledges 14, rods 15 and spacers 16 are made of rubber, plastics, ceramics or cast iron.

Figure 5:
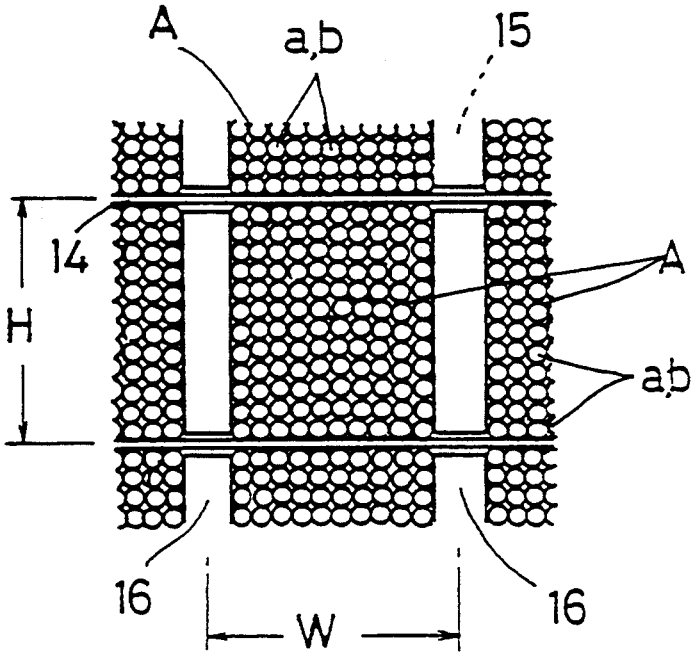
FIG. 5 is a view of part of the inner surface of the shell of the same embodiment.
Figure 8:
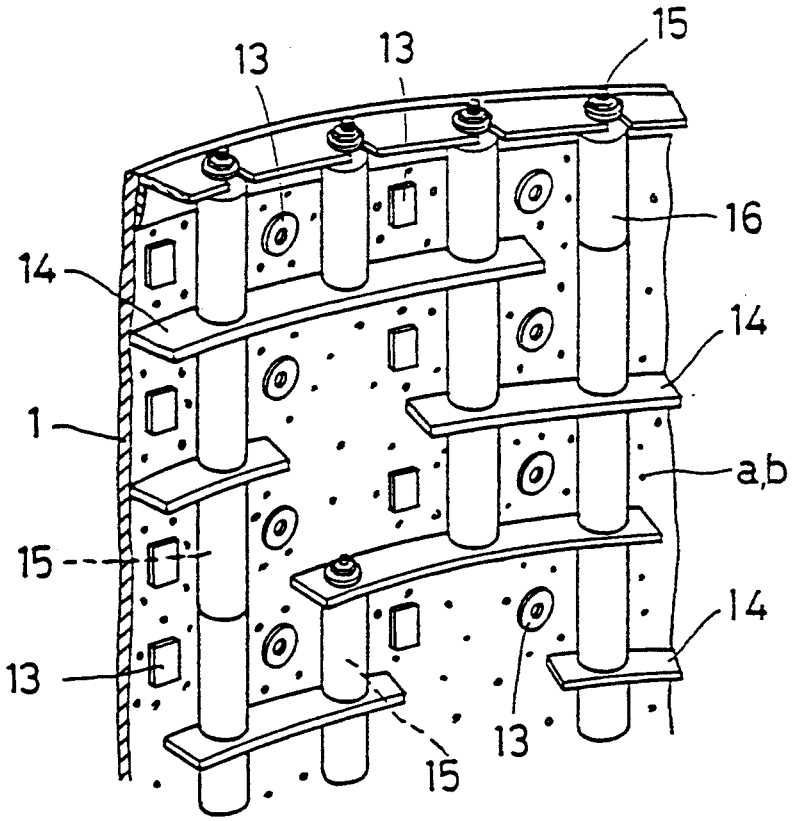
FIG. 8 is a partially cutaway perspective view of a shell of still another embodiment.
Figure 9:
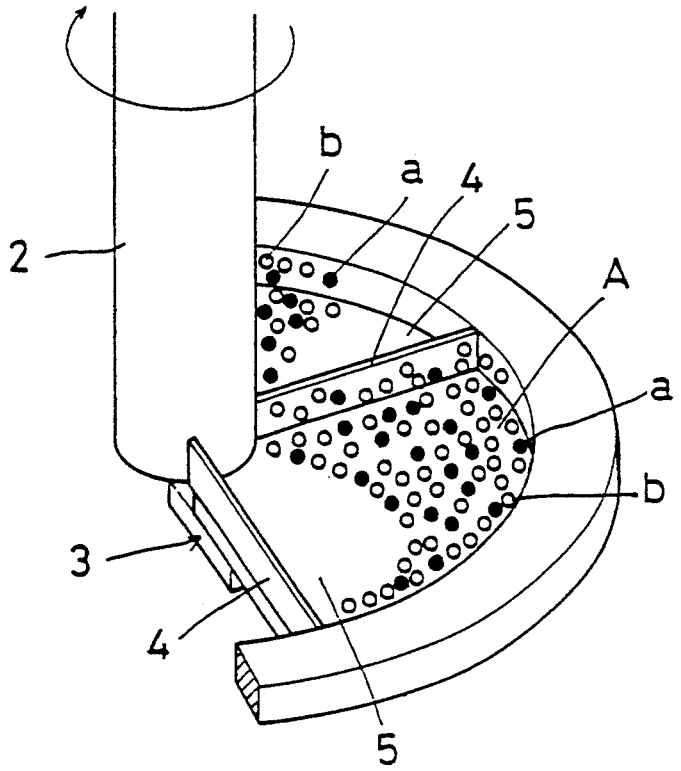
FIG. 9 is a partially cutaway perspective view of a screw of a conventional pulverizer.
Figure 10:
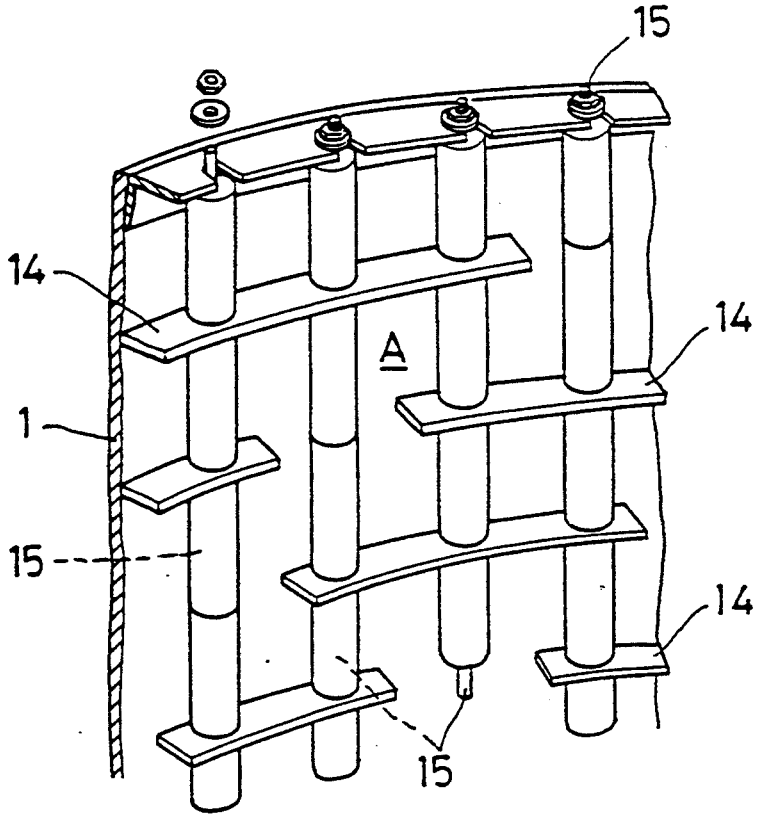
FIG. 10 is a partially cutaway perspective view of a shell of another conventional pulverizer.
Figure 11:
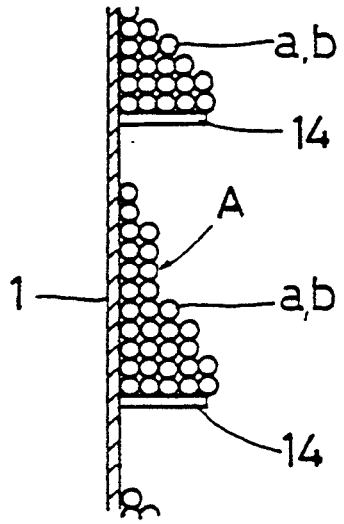
FIG. 11 is a sectional view of part of a shell of a conventional pulverizer.
Figure 12:
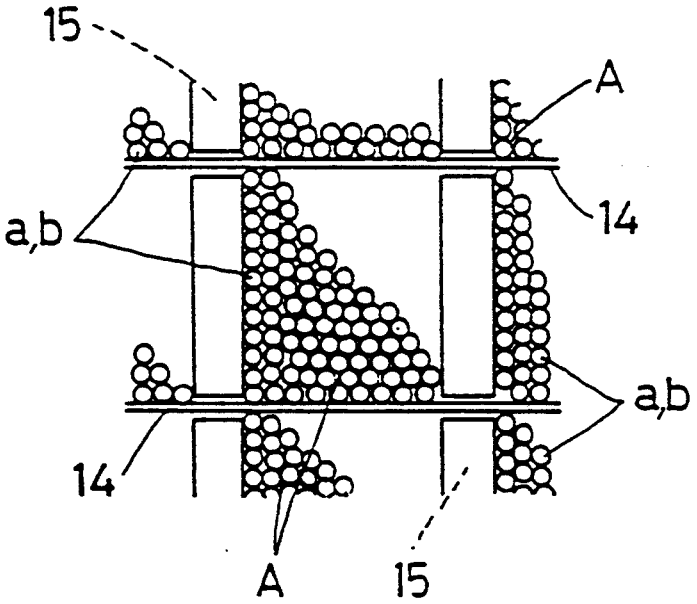
FIG. 12 is a view of the inner surface of the part of the shell of the conventional pulverizer.

In the spaces defined by the ledges 14 and rods 15, the magnets 13 are fixed to the blades. The magnets serve to attract the pulverizing medium b in the respective spaces, thus keeping uniform the thickness of the layer of pulverizing medium as shown in FIGS. 5 and 8. The magnets 13 (both on the inner surface of the shell and on the blades 3) may be circular as shown in FIG. 4, square or of any other desired shape. Their size is not limited, either. The magnets 15 may be mounted on the ribs 10, ledges 14, spacers 16 and/or rods 15. Alternatively, these members 10, 14, 15 and 16 themselves may be magnets.

The wear-preventive structure of the above-described embodiment, which is provided on the inner surface of the pulverizing shell 1 or the uppermost (top) surfaces of the screw blades 3, has the advantage that it does not have to be provided over the entire area of the inner surface of the shell 1 or of the top surfaces of the blades 3 as in case of conventional wear-resistant liners. Thus, the time and cost for mounting such a structure are one-tenth or less of those associated with the conventional arrangement. Also, the structure of the embodiment exhibited a durability more than about three times that exhibited by the conventional structure. Moreover, it was found that even without the ribs 10, rods 15 and ledges 14, the self-lining layers A can be formed fairly stably and the wear resistance can be kept high.

Figure 6:
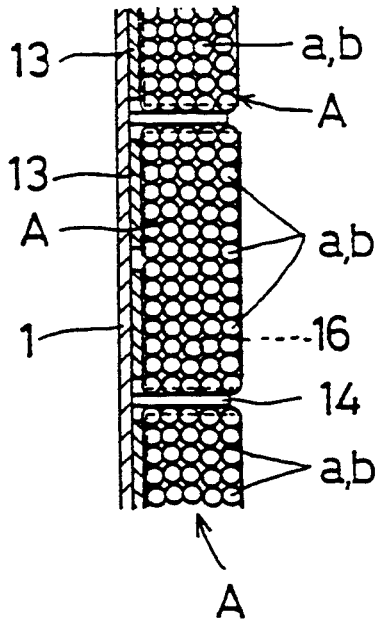
FIG. 6 is a sectional view of that part of the shell of the same embodiment.

Further, in this embodiment, as shown in FIGS. 5 and 6, the thickness of the self-lining layers A can be kept virtually uniform over the entire area. This makes it possible to provide a comparatively large the distance between ribs 10, distance W between rods 15 and distance H between ledges 14, so that the number of mounting steps are few. Thus, such a structure can be mounted easily and at low cost.

Further, the self-lining layers A serve to prevent the wear of not only the inner surface of the pulverizing shell 1 and the surfaces of the blades 5, but also the ribs 10, ledges 14 and rods 15, because the layers A fill up the spaces defined by these members, i.e. these members are completely buried in the layers A. Thus, their durability increases. The increased durability of the ribs 10, ledges 14 and rods 15 means less frequent maintenance jobs of the inner surface of the pulverizing shell 1 and the surfaces of the blade 5.

Also, since the the magnets 15 serve to attract the pulverizing medium b, thereby preventing it from falling or moving about, either the ledges 14 or the rods 15 (including spacers 16) may be omitted. Also, some of these member may be omitted as shown in FIG. 8. Plates similar to the ledges 14 may be used in place of the rods 15 (including spacers 16). In this case, the ridges 14 may be rod-shaped members. The plates and the ledges 14 may be mounted directly on the pulverizing shell 1 by welding.

In the embodiments, the carrier fluid d is air. But if the pulverizer is a vertical medium-stirring type, the carrier fluid may be a gas other than air or may be a liquid such as water. Further, the carrier fluid may be introduced into the pulverizing shell 1 through a port provided in the center or side of the bottom of the shell 1 as is well known in the art (e.g. Japanese Unexamined Utility Model Publication 4-37541).

What is claimed is:

1. A vertical medium-stirring pulverizer comprising: a vertically extending pulverizing shell having an inner surface; pulverizing medium filling part of said shell, the inner surface of said shell being exposed to said pulverizing medium; a screw including a shaft extending vertically in said shell, and a blade extending along said shaft, said blade having an uppermost surface located radially outwardly of the shaft of said screw and exposed to the interior of said shell and to said pulverizing medium occupying part of the interior of said shell; a plurality of magnets disposed on at least one of said inner surface of said shell and said uppermost surface of said blade, each of said magnets having an uppermost portion facing away from the surface on which it is mounted exposed at said surface to the interior of said shell and to said pulverizing medium.

2. A vertical medium-stirring pulverizer as claimed in claim 1, and further comprising a plurality of ribs disposed on said uppermost surface of said blade and spaced apart from one another, and wherein said magnets are disposed on the uppermost surface of said blade at locations between said ribs.

3. A vertical medium-stirring pulverizer as claimed in claim 1, and further comprising a plurality of spaced apart ribs extending vertically along the inner surface of said shell, and a plurality of spaced apart ledges extending horizontally along the inner surface of said shell, and wherein said magnets are disposed on the inner surface of said shell at locations between said ribs and said ledges.

4. In an operational vertical medium-stirring pulverizer including a vertically extending pulverizing shell having an inner surface, pulverizing medium filling part of said shell, the inner surface of said shell being exposed to said pulverizing medium, a screw including a shaft extending vertically in said shell and a blade extending along said shaft, said blade having an uppermost surface located radially outwardly of the shaft of said screw and exposed to the interior of said shell and thus to said pulverizing medium occupying part of the interior of said shell, and wherein at least one the pulverizer is a magnetic material, the improvement comprising a plurality of magnets disposed on at least one of said inner surface of said shell and said uppermost surface of said blade, each of said magnets having an uppermost portion facing away from the surface on which it is mounted exposed at said surface to the interior of said shell and to said pulverizing medium, said magnets having magnetism sufficient to attract said magnetic material thereto and onto said at least one of the inner surface and said uppermost surface.

5. In a vertical medium-stirring pulverizer as claimed in claim 4, the improvement further comprising a plurality of ribs disposed on said uppermost surface of said blade and spaced apart from one another, and said magnets being disposed on the uppermost surface of said blade at locations between said ribs.

6. In a vertical medium-stirring pulverizer as claimed in claim 4, the improvement further comprising a plurality of spaced apart ribs extending vertically along the inner surface of said shell, and a plurality of spaced apart ledges extending horizontally along the inner surface of said shell, and said magnets being disposed on the inner surface of said shell at locations between said ribs and said ledges.

* * * * *